United States Patent [19]

West

[11] 4,360,991

[45] Nov. 30, 1982

[54] MOVABLE ROOM DIVIDING PARTITION

[76] Inventor: Evelyn M. West, Box 307, Gracie Station, New York, N.Y. 10028

[21] Appl. No.: 185,543

[22] Filed: Sep. 9, 1980

[51] Int. Cl.[3] ..... E04B 1/34; A47B 5/00; B66B 9/00

[52] U.S. Cl. ..... 52/29; 49/70; 49/370; 52/36; 52/64; 312/286

[58] Field of Search ..... 52/29, 36, 64; 49/70, 49/370; 312/286, 198

[56] References Cited

U.S. PATENT DOCUMENTS

| | | | |
|---|---|---|---|
| 104,041 | 6/1870 | Koch | 52/29 |
| 1,477,660 | 12/1923 | Monroe | 52/29 |
| 1,570,427 | 1/1926 | Bie | 52/36 |
| 2,027,491 | 1/1936 | Percy | 52/36 X |
| 2,657,436 | 11/1953 | Fairhurst et al. | 52/64 |
| 2,694,232 | 11/1954 | Wolfe | 52/64 X |
| 2,742,675 | 4/1956 | Robertson | 52/143 X |
| 2,857,197 | 10/1958 | Hogg | 52/64 X |
| 3,421,459 | 1/1969 | Sherwood | 52/64 |
| 3,570,683 | 3/1971 | Dickgiesser | 52/64 |

FOREIGN PATENT DOCUMENTS

| | | | |
|---|---|---|---|
| 2313882 | 9/1974 | Fed. Rep. of Germany | 52/36 |
| 586469 | 3/1947 | United Kingdom | 52/64 |

*Primary Examiner*—Alfred C. Perham
*Attorney, Agent, or Firm*—Natter & Natter

[57] ABSTRACT

A room dividing partition includes a plurality of upright utility modules with at least one module being movable to selectively close a span or an opening, thereby separating an area into two smaller units. The movable module comprises an upright rigid structure having a utility depth for storage or other purposes and a plurality of friction reducing rollers which engage one or more tracks positioned along the floor. In order to stabilize the module and prevent tipping, a guide rail extends between side walls of the area across the opening. A rail engaging gaff projects from the movable module with the gaff being movable along the rail when the module is moved. The module may include various storage devices such as shelves, cabinetry and self-contained furniture articles such as table or desk tops.

10 Claims, 8 Drawing Figures

MOVABLE ROOM DIVIDING PARTITION

BACKGROUND OF THE INVENTION

1. Field of the Invention

This invention relates generally to room or area dividers and more particularly to room dividers incorporating movable partitions having a utility depth.

2. Brief Description of the Prior Art

Room dividers have been employed to divide large rooms for multi-function purposes such as meetings, parties and the like. When smaller areas were desired, the partitions were closed so that a group of persons of reduced number would not feel uncomfortable in a large area or for the purpose of providing two areas for simultaneous use by smaller groups of persons.

Room dividers have heretofore comprised movable partitions suspended from a ceiling track and having a plurality of parallel vertical hinge or fold lines. When a particular area was desired to be partitioned, the divider, which was stored in a compressed pleated accordion fashion, was stretched and moved along the track to form an enclosure wall thus dividing a larger space into two or more areas.

The prior accordion pleated room dividers presented distinct disadvantages. Of substantial significance was the fact that a room which was divided in accordance with these prior structures always maintained the appearance of a divided larger area since the accordion pleated divider was a substantially conspicuous element. Furthermore, because the room divider was usually formed of thin flexible material, the appearance of a strong or sturdy partition wall could not be presented. Thus, at a social gathering, guests were required to be wary of the yieldable nature of the partition. Accordingly, people were reluctant to lean against such partition walls and could not employ such partitions as supporting surfaces. This, of course, resulted in inefficient space utilization. Such inefficiency in space utilization was further compounded by the very fact that an open partition was required to be stored along the side walls, thus depriving the area of otherwise utilizable space.

SUMMARY OF THE INVENTION

In compendium, the present invention comprises an upright area dividing partition formed of one or more movable utility modules such as book cases. The movable module includes a plurality of wheels which may engage one or more tracks formed on a supporting surface. In order to prevent the utility module from tipping in the presence of lateral forces as may be encountered during movement or when materials stored therein are accessed, a stabilizing guide rail spans across the opening which is selectively closed by the utility module. A rail engaging gaff projects laterally from the top of the movable module.

The movable module may include various utility components such as shelves, self-contained furniture articles or comprise cabinets having doors, etc.

From the above summary, it will be appreciated that it is an object of the present invention to provide a movable room dividing partition of the general character described which is not subject to the disadvantages of the prior art as aforementioned.

A further object of the present invention is to provide a movable room dividing partition of the general character described which promotes maximum space utilization in either open or closed position.

Another object of the present invention is to provide a movable room dividing partition of the general character described which is suited for article storage purposes.

A further object of the present invention is to provide a movable room dividing partition of the general character described which is inconspicuous in appearance.

Yet another object of the present invention is to provide a movable room dividing partition of the general character described which is sturdy and well suited for load supporting purposes.

Still a further object of the present invention is to provide a movable room dividing partition of the general character described which is suitable for economic mass production fabrication.

Another object of the present invention is to provide a movable room dividing partition of the general character described having a functional furniture feature.

Other objects in part will be obvious and in part will be pointed out hereinafter.

With these ends in view, the invention finds embodiment in certain combinations of elements and arrangements of parts by which the objects aforementioned and certain other objects are hereinafter attained, all as fully described with reference to the accompanying drawings and the scope of which is more particularly pointed out and indicated in the appended claims.

BRIEF DESCRIPTION OF THE DRAWINGS

In the accompanying drawings in which are shown some of the various possible exemplary embodiments of the invention.

DESCRIPTION OF THE PREFERRED EMBODIMENTS

Figure 1:
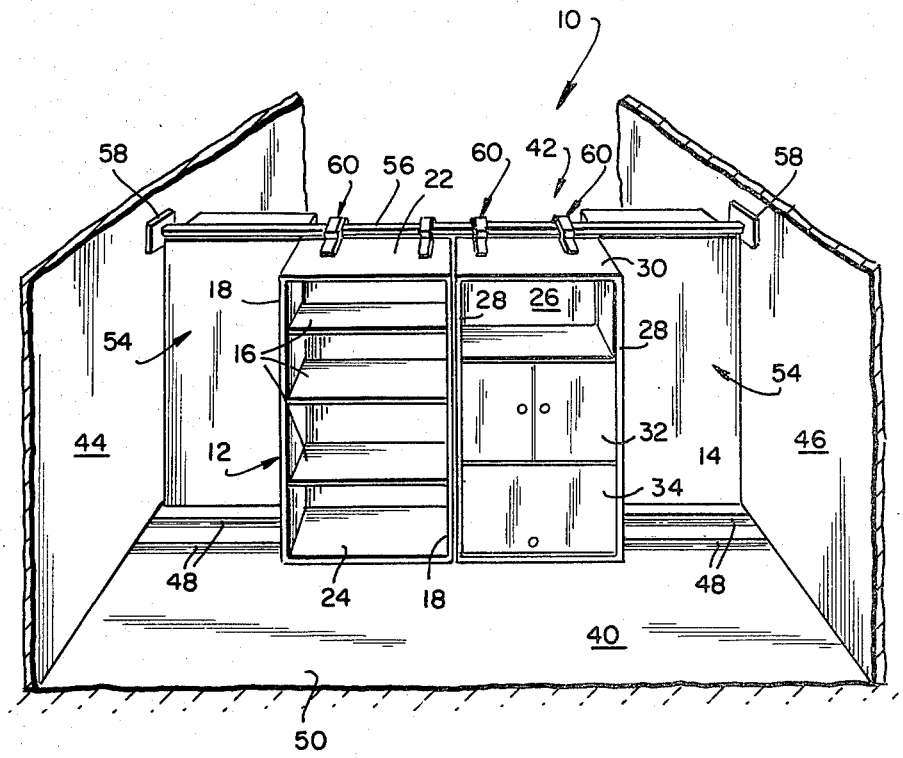
FIG. 1 is a fragmentary perspective view of an area defined by a floor and side walls and with the area being separated into two smaller units by a room dividing partition constructed in accordance with and embodying the invention.

Referring now in detail to the drawings, the reference numeral 10 denotes generally a room partition constructed in accordance with and embodying the present invention. In the exemplary embodiment herein described the room partition 10 comprises a pair of upright utility modules 12, 14. The utility module 12 is formed as a bookcase having a plurality of shelves 16. The shelves 16 span between a pair of upright side walls 18 and project forwardly from a rear panel 20. A top wall 22 and bottom shelf 24 are also provided.

The utility module 14 comprises an article of office furniture and includes a rear panel 26, a pair of side walls 28 and a top wall 30. The module 14 includes within its utility depth, as measured by the depth of its side walls 28, a storage cabinet having vertically hinged doors 32 and a lateral pull-out filing drawer of conventional design having a front panel 34.

Figure 2:
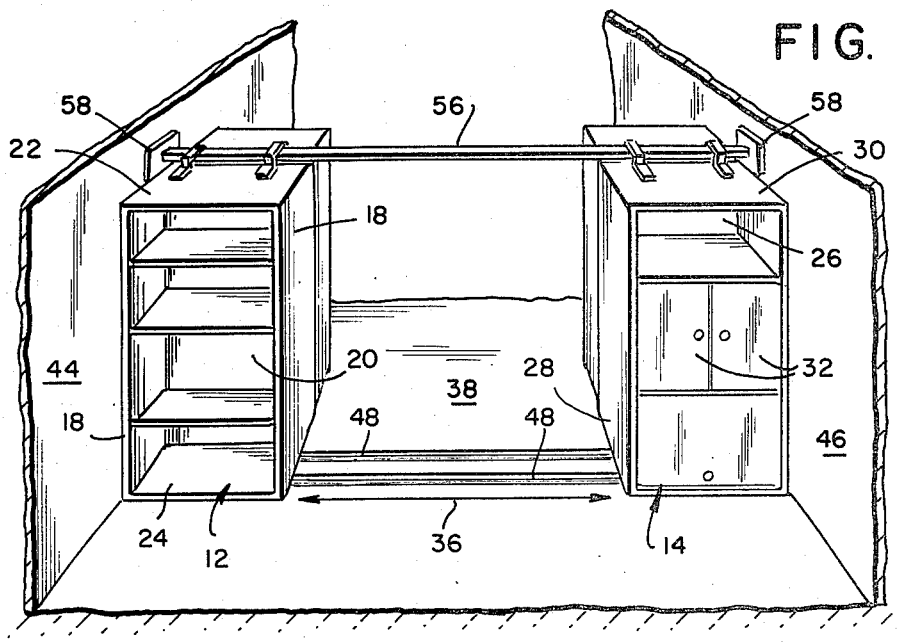
FIG. 2 is a further perspective illustration of the same area with the partition being opened to present the larger area as a unified entity.

Pursuant to the present invention, the utility modules 12, 14 are movable across a span or opening denoted by the heavy arrow 36 in FIG. 2 to selectively divide a room area 38 (shown in FIG. 2) into two smaller area units 40, 42 (as shown in FIG. 1). Movement of the modules 12, 14 in a direction transverse to a pair of parallel walls 44, 46 of the area 38 is facilitated by one or more tracks 48 which extend across a floor or supporting surface 50 of the area 38.

Figure 3:
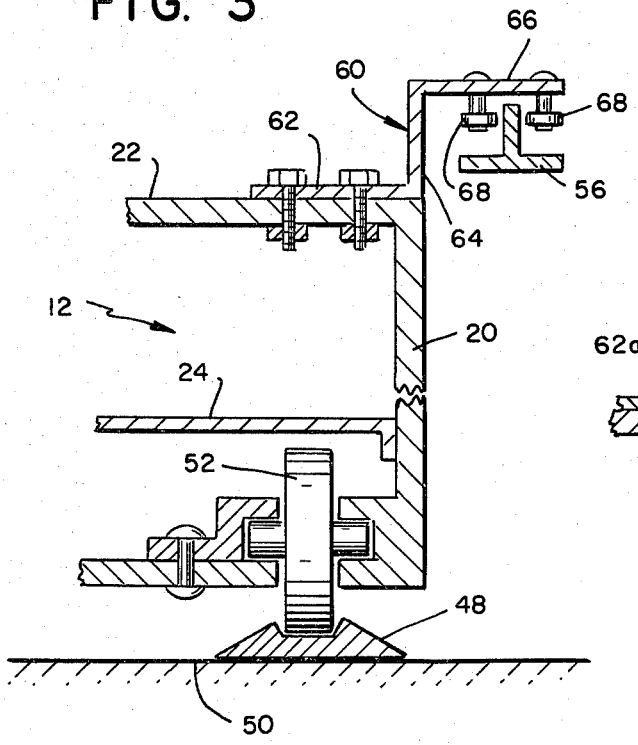
FIG. 3 is an enlarged fragmentary sectional view through a movable utility module of the partition and showing a gaff which extends from the top of a utility module to engage a rail thereby preventing the module from tipping; additionally shown is a wheel journalled for rotation at the bottom of the utility module and engaging a track to facilitate movement of the module for opening and closing the partition.

As shown in FIG. 3, a plurality of wheels 52 are journalled for rotation at the bottom of each utility module 12, 14 in an area beneath the bottom shelf 24. The wheels 52 are in rolling engagement with the tracks 48 to facilitate movement of the modules 12, 14 between the positions shown in FIGS. 1 and 2.

From an observation of FIG. 1 wherein the modules 12, 14 are shown in a room dividing position, it will be seen that a pair of fixed modules 54 are positioned with their side walls in abutment against the walls 44, 46 of the area and may be secured or anchored thereto. The fixed modules 54 thus effect a complete blockage and separation between the smaller unit areas 40, 42.

When the room area 38 is unified (the partition 10 is open as shown in FIG. 2), the movable modules 12, 14 are in back to back relationship with the fixed modules 54. The fixed modules 54 may comprise bookcases, storage shelves or other articles of furniture accessible to and facing the smaller unit area 42 while the shelves and furniture of the utility modules 12, 14 face and are accessible to the smaller unit area 40. This relationship is, however, a matter of design choice and the present invention is well suited for both the utility modules and the fixed modules accessible to the same smaller unit area.

Pursuant to the present invention, the movable utility modules 12, 14 are accessed for the removal of articles stored therein. As such, files may be removed and movable filing drawers opened. In order to preclude the utility modules 12, 14 from tipping when accessed by a user or inadvertently leaned upon, a stabilizing guide rail 56 is provided. The guide rail 56 extends between the area walls 44, 46 adjacent the tops of the utility modules 12, 14 and are anchored to the walls 44, 46 by suitable means such as anchoring plates 58 which are securely fastened to the walls by engagement with wall studs or through hollow wall fasteners and the like.

Referring again to FIG. 3, a typical guide rail 56 is shown in transverse cross-section. The guide rail 56 has a cross-sectional configuration of an inverted letter T and is positioned behind the rear panel 20 of the movable module 12. As previously mentioned, a plurality of gaffs 60 project rearwardly from the movable modules 12, 14 and engage the rail 56.

Each gaff 60 may comprise an angular metal bracket which is secured to the top wall of a movable module and extends in overlapping relationship over the longitudinal axis of the guide rail 56. The gaff 60 (shown in FIG. 3) includes a planar base 62 anchored to the top wall 22 of the module 12, an upright leg 64 projecting from the base 62 and a horizontal rearwardly projecting panel 66 which extends from the upper end of the leg 64.

The panel 66 in turn supports a pair of spaced roller assemblies 68 which may engage the stem of the inverted T guide rail when the module 12 is slightly displaced from its vertical plane. Either of the two roller assemblies 68 will contact the guide rail 56 depending upon the direction of any lateral force applied to the movable module. For example, if a force applied to the movable module 12 tends to create a counterclockwise tipping moment (as viewed in FIG. 3), the outer roller assembly 68 will contact the guide rail 56 and prevent the movable module 12 from tipping. Conversely, if a force is applied to the module 12 which creates a clockwise tipping moment, the inner roller assembly 68 would contact the guide rail 56 and thus prevent tipping. Optionally, both roller assemblies may be in constant engagement.

While only a single gaff 60 has been described, a plurality of identical gaffs are fixed to both movable modules 12, 14. Furthermore, a gaff may comprise a continuous channel bar extending the entire width of each movable module.

Figure 4:
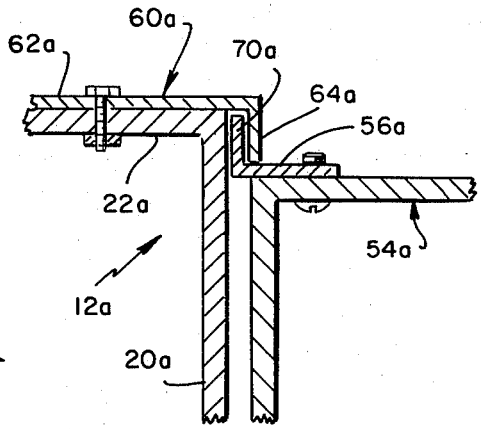
FIG. 4 is a fragmentary sectional view through a utility module constructed in accordance with an alternate embodiment of the invention and showing a variant configuration of the rail and gaff.

In FIG. 4 an alternate embodiment of the present invention is illustrated. In this embodiment, like numerals denote like components as the prior embodiment, however bearing the suffix "a". This alternate embodiment is substantially identical to the embodiment previously described except that an alternate guide rail **56*a* comprises an angle iron having an upwardly extended leg 70*a* and with the horizontal base of the angle iron being secured to the top of a fixed module 54*a*. The fixed module 54*a* is similar to the module 54** previously described and in view of the fact that fixed modules do not employ wheels and are not seated upon rails, the tops of the fixed modules may project to an elevation lower than that of the movable modules.

The guide rail **56*a* is shown attached to the fixed module 54*a*** only in an exemplary fashion and may be secured across the side walls of the area to be divided in a manner identical to that described with respect to the guide rail of the prior embodiment.

The guide rail **56*a* is engaged by a gaff 60*a* which comprises a similar angle iron having a downwardly extending leg 64*a* and a horizontal base 62*a* which is secured to the top wall 22*a* of a movable module 12*a*. The gaff 60*a* may be formed of a unitary angle iron or a plurality of individual gaffs 60*a***, each comprising an angle iron segment and each secured to the top wall of a movable module.

The movable modules are prevented from tipping in a manner similar to that described with reference to the prior embodiment. As such, the leg **70*a* of the angle iron rail 56*a* contacts either the leg 64*a* of the gaff or the rear panel 20*a* of the movable module 12*a*** to prevent tipping.

Figure 5:
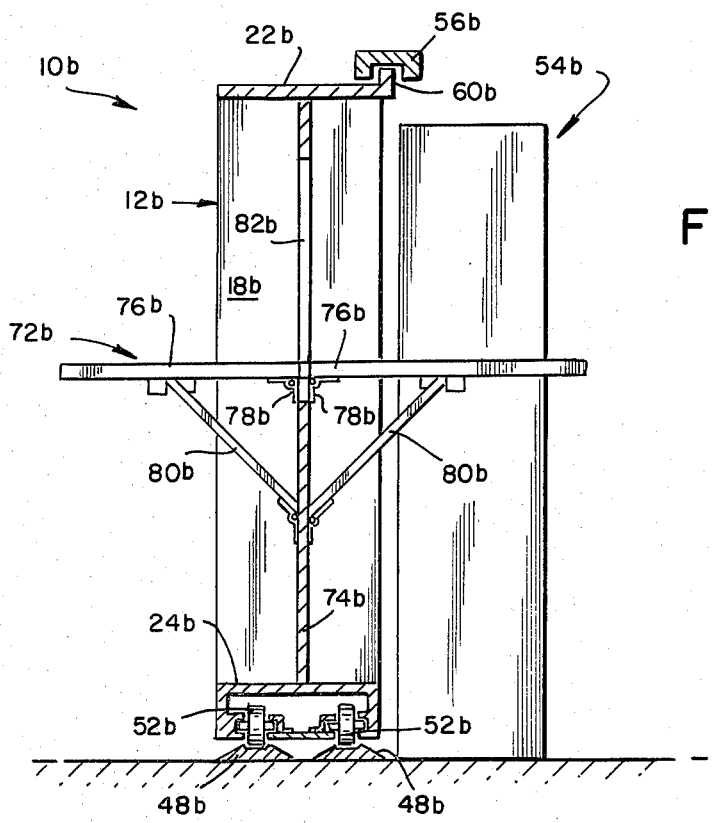
FIG. 5 is a reduced scale sectional view through a further embodiment of the invention wherein the utility module includes a self-contained drop leaf table.

In FIG. 5 a still further embodiment of the invention is shown wherein a movable module 12*b* includes an alternate rail-gaff configuration and further carries a self-contained drop leaf table unit. In this embodiment, like numerals denote like components as heretofore described with respect to prior embodiments, however bearing the suffix "b".

A room divider 10*b* constructed in accordance with this alternate embodiment includes a movable module 12*b* of modified design and which carries, intermediate its side walls 18*b*, a self-contained twin leaf folding table 72*b*. Accordingly, the partition 10*b* is well suited for room dividing applications wherein table surfaces are desired such as for the purpose of dividing a large kitchen-dining area into separate kitchen and dining facilities.

If the partition 10*b* is utilized for such purposes, it should be appreciated that in addition to the table carrying module 12*b*, further movable modules may contain cabinetry or shelving suited for kitchen and/or dining room use. As such, cabinetry or shelving contained in alternate or additional fixed and/or movable modules would carry dishes, pots and pans, silverware and other dining accoutrements. For example, the cabinetry or shelving exposed to the kitchen area might well carry kitchen appliances, e.g. mixers, toasters, coffee makers, etc. suitable for electrical connection through a flexible extension type cord.

With reference again to the movable module 12*b*, such module includes in lieu of a rear panel, an intermediate vertical panel 74*b* which extends between a top wall 22*b* and a bottom shelf 24*b*. A pair of drop leaf table tops 76*b* are pivotally mounted to opposite sides of the upright panel 74*b* by a suitable hinge 78*b*. The table tops 76*b* are supported in open, horizontal position by one or more legs 80*b* which are also hinged to the intermediate panel 74*b* and engage the undersurface of each table top.

In order to promote a convenient interrelationship between the kitchen and dining areas which have been partitioned, an optional pass-through aperture 82*b* may be formed in the upright panel 74*b*.

Figure 7:
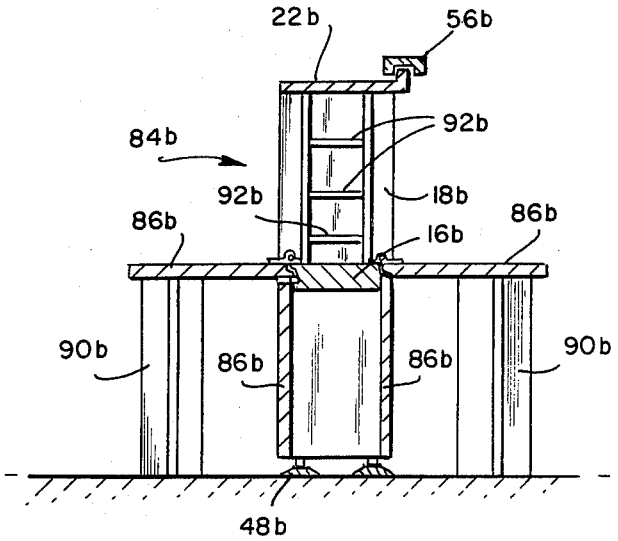
FIG. 7 is a reduced scale sectional view through a further utility module similar to the embodiment of FIG. 5.
Figure 8:
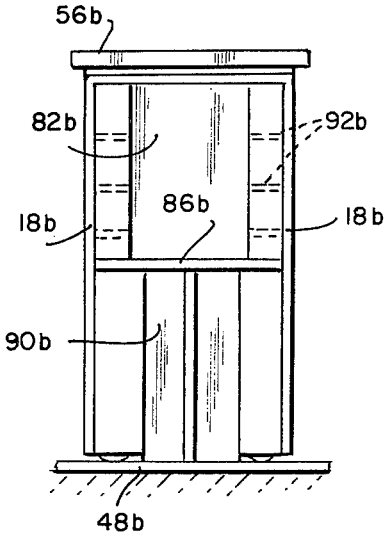
FIG. 8 is a front elevational view of the module shown in FIG. 7.

In FIGS. 7 and 8 a further movable module 84*b* similar to the module 12*b* is shown. A pair of drop leaf tables 86*b* are hinged to a shelf 16*b* joining a pair of front and rear panel sections. A free standing table support leg 90*b* of X-shaped cross section may be employed to support the table tops 86*b* when opened. Either or both tables may be employed at the same time.

A plurality of internal shelves 92*b* may project from one or both side walls 18*b* of the module 84*b*. Such shelves are well suited to carry implements which may be employed in conjunction with the use of the tables 86*b*. For example, if the module 84*b* is used to separate a kitchen from a larger area, the table 86*b* may be used for dining purposes and condiments or the like may be stored on the shelves 92*b*. If the tables 86*b* are employed as a desk or other work area, similarly appropriate articles may be stored on the shelves 92*b*.

The room partition 10*b* further differs from the partitions previously described with respect to the guide rail and gaff arrangement. A modified guide rail 56*b* is formed of an inverted U-shaped channel which extends between the side walls of the area to be divided. A mating gaff 60*b* is formed as a unitary upright extension projecting from the rear edge of the top wall 22*b* of the movable module 12*b*. The gaff 60*b* extends between the downwardly projecting legs of the guide rail 56*b* and will engage either of the guide rail legs to prevent the movable module from tipping.

Figure 6:
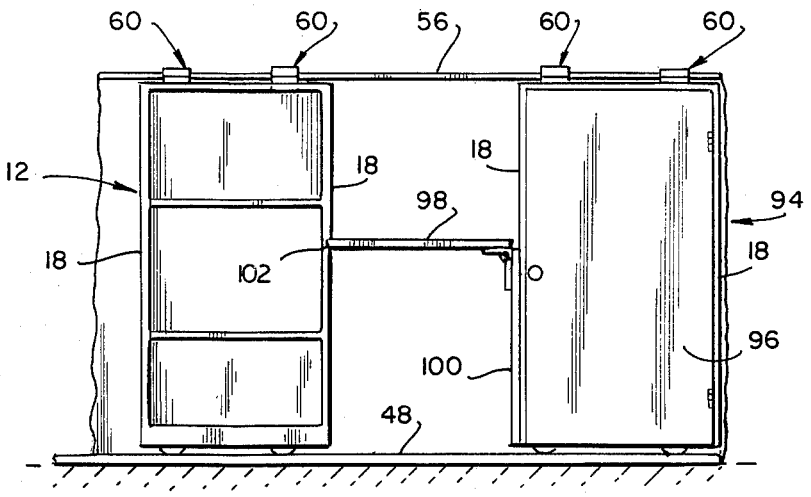
FIG. 6 is a front elevational view of further utility modules wherein an integral shelf spans an opening.

FIG. 6 illustrates a further room partition arrangement wherein a drop leaf is hinged for movement in a longitudinal rather than transverse plane and is adapted to span between an opening formed when two movable modules are separated. A module 94 is similar to the modules previously described and comprises a clothes or utility closet or locker having a vertically hinged door 96.

A side wall 18 of the module 94 includes a drop leaf 98 which is hinged along a horizontal axis perpendicular to the plane within which the modules move. The drop leaf 98 is hinged to an upright panel 100 abutted against the side wall 18 of the module 94. When the drop leaf is not to be used, it is pivoted to an upright position in abuttment against the upper half of the side wall 18. The movable modules 12 and 94 may then be placed in abuttment against one another with the side wall of the module 12 abutting against the leaf 98 and the panel 100.

When the leaf 98 is to be opened, the modules are separated and the leaf pivoted to a horizontal position. The free end of the leaf engages a groove 102 formed in the side wall of the module 12. The modules 12, 94 may include a vertical pin which engages any of a plurality of apertures in the track 48 to prevent movement of the modules which might otherwise disengage the drop leaf 98 from the groove 102.

The room partition of the present invention is readily adaptable for use in pedagogic environments. For example, a large classroom may be easily divided into smaller instructional areas such as demonstration areas and the modules may be employed to store or carry school supplies. In addition, the modules may comprise lockers for students' use as well as storage areas for laboratory, sports or other equipment.

The room partition of the present invention is also well adapted for use in professional offices and may serve as movable partitions for conference or meeting rooms as well as providing, in the utility depth of the modules, storage areas for office supplies as well as coats, etc.

Furthermore, among the articles of furniture which may be carried in the utility modules are folding bed mechanisms, chair mechanisms and the like.

Various modifications of the wheel and rail mechanism are readily apparent. For example, the floor rail may comprise recessed grooves formed in the floor rather than rails positioned on top of existing flooring. Furthermore, the manner of securing the wheels to the undercarriage of the movable modules has been shown in an exemplary fashion only. Various mounting mechanisms may be equally employed.

It should also be appreciated that numerous alternate configurations for the guide rail and gaff may be provided without departing from the spirit of the present invention. Additionally, the room partition of the present invention may be employed with movable modules only rather than a combination of movable and fixed modules. In such configuration, the position of the open space between the area sections when the partition is open may be varied and is not constrained to that shown in FIG. 2. For example, with four movable modules, pairs of back-to-back modules can be placed adjacent either wall.

It should also be appreciated that the particular number of movable and/or fixed modules employed is not of major significance to the present invention. Thus, as little as one movable module may be employed in one vertical plane in combination with one or more fixed or movable modules which lie in a parallel vertical plane.

Thus, it will be seen that there is provided a movable room partition which achieves the various objects of the invention and which is well suited to meet the conditions of practical use.

As various changes might be made in the invention as above set forth, it is to be understood that all matter herein described or shown in the accompanying drawings is to be interpreted as illustrative and not in a limiting sense.

Having thus described the invention, there is claimed as new and desired to be secured by Letters Patent:

1. A room dividing partition adapted to selectively close an opening thereby converting a large room area into smaller unit areas, the partition comprising an upright movable utility module, the movable module including a vertical panel, a pair of opposed side walls and a top wall extending perpendicular to the vertical panel, means for the storage of articles between the side walls, means facilitating guided movement of the movable module in a vertical plane across the opening, the facilitating means including wheel means mounted to the module, the movable module further including stabilizing means adapted to prevent tipping of the module in the presence of moments lying in planes transverse to the vertical plane of guided movement, the stabilizing means including elevated rail means and means securing the rail means in a plane parallel to the plane of guided movement, the stabilizing means further including gaff means interconnecting the rail means with the movable module, a stationary module, the stationary module having a rear vertical panel lying in a plane spaced from and parallel to the plane of guided movement, the movable module and the stationary module extending in back-to-back relationship when the partition is in its open position.

2. A room dividing partition constructed in accordance with claim 1 wherein the module includes an article of furniture.

3. A room dividing partition constructed in accordance with claim 2 wherein the article of furniture comprises a bookcase.

4. A room dividing partition constructed in accordance with claim 1 including a second stationary module and a second movable module, each of the stationary modules being positioned adjacent one side wall of the large room area, each of the movable modules being movable along the plane of guided movement to an open position wherein each movable module lies in back-to-back relationship with a stationary module.

5. A room dividing partition constructed in accordance with claim 4 wherein the means securing the rail means comprises means fixing the rail means to each stationary module.

6. A room dividing partition constructed in accordance with claim 1 wherein the means facilitating guided movement includes track means interconnecting the wheel means and a supporting surface.

7. A room dividing partition constructed in accordance with claim 1 wherein the gaff means projects from the top wall.

8. A room dividing partition constructed in accordance with claim 7 wherein the gaff means projects upwardly from the top wall.

9. A room dividing partition constructed in accordance with claim 7 wherein the gaff means projects toward the stationary module.

10. A room dividing partition constructed in accordance with claim 1 further including a second stationary module, each of the stationary modules being positioned adjacent one side wall of the large room area, the movable module being movable along the plane of guided movement to an open position wherein the movable module lies in back-to-back relationship with one of the stationary modules.

* * * * *